United States Patent [19]

Stenglein

[11] Patent Number: 4,493,499

[45] Date of Patent: Jan. 15, 1985

[54] DOOR LATCH

[75] Inventor: Paul R. Stenglein, Liverpool, N.Y.

[73] Assignee: Carrier Corporation, Syracuse, N.Y.

[21] Appl. No.: 438,131

[22] Filed: Nov. 1, 1982

[51] Int. Cl.[3] ..... E05C 1/14

[52] U.S. Cl. ..... 292/158; 292/DIG. 57

[58] Field of Search ..... 292/186, 156–162, 292/193, DIG. 57, DIG. 71

[56] References Cited

U.S. PATENT DOCUMENTS

| | | | |
|---|---|---|---|
| 1,515,612 | 11/1924 | O'Connor | 292/161 X |
| 2,108,965 | 2/1938 | Gray | 292/DIG. 71 |
| 2,864,640 | 12/1958 | Mattinson . | |
| 3,090,427 | 5/1963 | Stroup et al. . | |
| 3,633,389 | 1/1972 | Horgan, Jr. . | |
| 3,845,976 | 11/1974 | Peterson . | |
| 3,944,267 | 3/1976 | Sundquist . | |
| 4,025,096 | 5/1977 | Geer | 292/158 |
| 4,099,751 | 7/1978 | Poe et al. . | |
| 4,216,725 | 8/1980 | Hallam . | |

FOREIGN PATENT DOCUMENTS

| | | | |
|---|---|---|---|
| 69278 | 5/1945 | Norway | 292/193 |

OTHER PUBLICATIONS

Photocopy of McQuay Corp. Door Latch Mechanism.
A Print of Details of McQuay Door Latch.

*Primary Examiner*—Richard E. Moore
*Attorney, Agent, or Firm*—Robert H. Kelly

[57] ABSTRACT

Apparatus for securing a swinging end of a hinged door in a closed position is disclosed. A slidable latch assembly including spaced rollers for engaging angled contact surfaces extending from a door are all arranged with appropriate spacing to secure the door in position upon slidable displacement of the latch assembly. A complex pivoted latch handle is utilized to appropriately displace the latch assembly for either securing or opening the door.

10 Claims, 8 Drawing Figures

DOOR LATCH

BACKGROUND OF THE INVENTION

1. Field of the Invention

This invention relates to a door latch for securing the free end of a hinged door. More particularly, the present invention concerns a sliding latch mechanism for freely engaging a door to maintain the door in a sealed position.

2. Prior Art

A typical rooftop type air conditioning unit includes a refrigeration circuit having a compressor, condenser and evaporator located in a cabinet mounted on the roof of or adjacent to an enclosure to be conditioned. Air is circulated between the enclosure to be conditioned and the rooftop unit. A portion of the rooftop unit is utilized to define a flow path for the air being circulated, said air passing in heat exchange relation with a portion of the refrigeration circuit within the unit.

The typical rooftop unit is divided into an indoor section and an outdoor section. The outdoor section may include the condenser and compressors of the refrigeration circuit. Outdoor ambient air is circulated over the condenser to effect heat transfer from the refrigerant flowing through the condenser to the air such that the refrigerant is cooled and changes state from a gas to a liquid. The refrigerant then travels to an evaporator located within the indoor section of the unit. Within the evaporator, the refrigerant changes state from a liquid to a gas absorbing its heat of vaporization from air flowing through the indoor section. This indoor air is typically circulated back to the enclosure to be conditioned to provide a supply of cooled air. A fan may be mounted within the indoor section for circulating air back to the enclosure. The refrigerant then flows from the evaporator back to the compressor where it is increased in temperature and pressure and then circulated to the condenser to complete the cycle.

In order to properly service an air conditioning unit, access must be had to the interior thereof. Access is typically made available through a hinged or other type door opening to allow the serviceman to repair or inspect the evaporator, indoor fan or other components in the interior of the unit. Since this door mechanism defines a portion of the air flow path it is preferably sealed to prevent water leakage between the exterior of the unit into the indoor air flow stream and to prevent air leakage between the indoor flow path and the exterior of the unit. Additionally, this door arrangement must be sufficiently strong that integrity is maintained while the unit is shipped and being erected in place. Often, rooftop units are raised in position utilizing an overhead crane creating significant structural stress on the unit. The door latch mechanism must maintain the door in position notwithstanding this construction stress.

Previous door securing arrangements included engaging metal to metal contact surfaces. These arrangements had the problem of allowing no tolerance such that the severe strains during erection might cause separation of components beyond the tolerance of the latch resulting in incomplete door sealing. Metal to metal components further had the problems of difficult sealing and hard to operate mechanisms and presented difficulties for the serviceman.

The herein disclosed latch mechanism utilizes rolling contact surfaces to engage inclined contact angles to secure the door in position. Sufficient overlap is provided between the roller contact and the contact angle to allow relative displacement between the two and still provide for complete sealing of the unit. Additionally, by providing rolling contact surfaces an assembly is utilized wherein the entire door mechanism operates smoothly and freely and wherein access to the unit is both dependable and not a problem for the serviceman.

SUMMARY OF THE INVENTION

It is an object of the present invention to provide a door latch for securing a door in a sealed position.

It is a further object of the present invention to provide a freely operating door latch having significant allowances for variations between the door and a post.

A yet further object of the present invention is to provide a mechanism capable of securing a door in a closed position while allowing the door to open to an open position.

It is a further object of the present invention to provide a door latch mechanism manually operable by a serviceman and capable of being freely and intermittently operated without obstruction.

It is a yet further object of the present invention to provide a safe, economical and reliable door latch mechanism for securing a hinged door in a rooftop type air conditioning unit.

Other objects will be apparent from the description to follow and the appended claims.

The above objects are achieved according to a preferred embodiment of the invention by the provision of apparatus for securing the swinging end of a hinged door in a closed position, said door including an end surface extending the thickness of the door and being in a plane generally tangent to an arch having the door hinge as its center of rotation which comprises at least one contact projection mounted to and extending from the door end surface, said contact projection including a contact face perpendicular from the end surface of the door and angled from a line parallel to the axis of rotation of the hinge. A latch assembly including a base plate and a rotatable contact means capable of being arranged in registration with the contact projection for securing the door in a closed position is further disclosed. Means for displacing the latch assembly between a closed position wherein the contact means is arranged in registration with the contact projection and an open position wherein the contact projections are not engaged by the contact means are set forth.

DESCRIPTION OF THE PREFERRED EMBODIMENT

The door latch mechanism as described hherein will be utilized in reference to a large swinging door having a hinge located adjacent one end for rotational motion and having a latch mechanism located at the opposite end for securing the door. This door will be described as the service or access door to a rooftop type air conditioning unit and is typically of large size such as 4 feet by 8 feet. It is to be understood that this latch mechanism has like applicability to other types of doors used for other purposes and in other applications.

Figure 1:
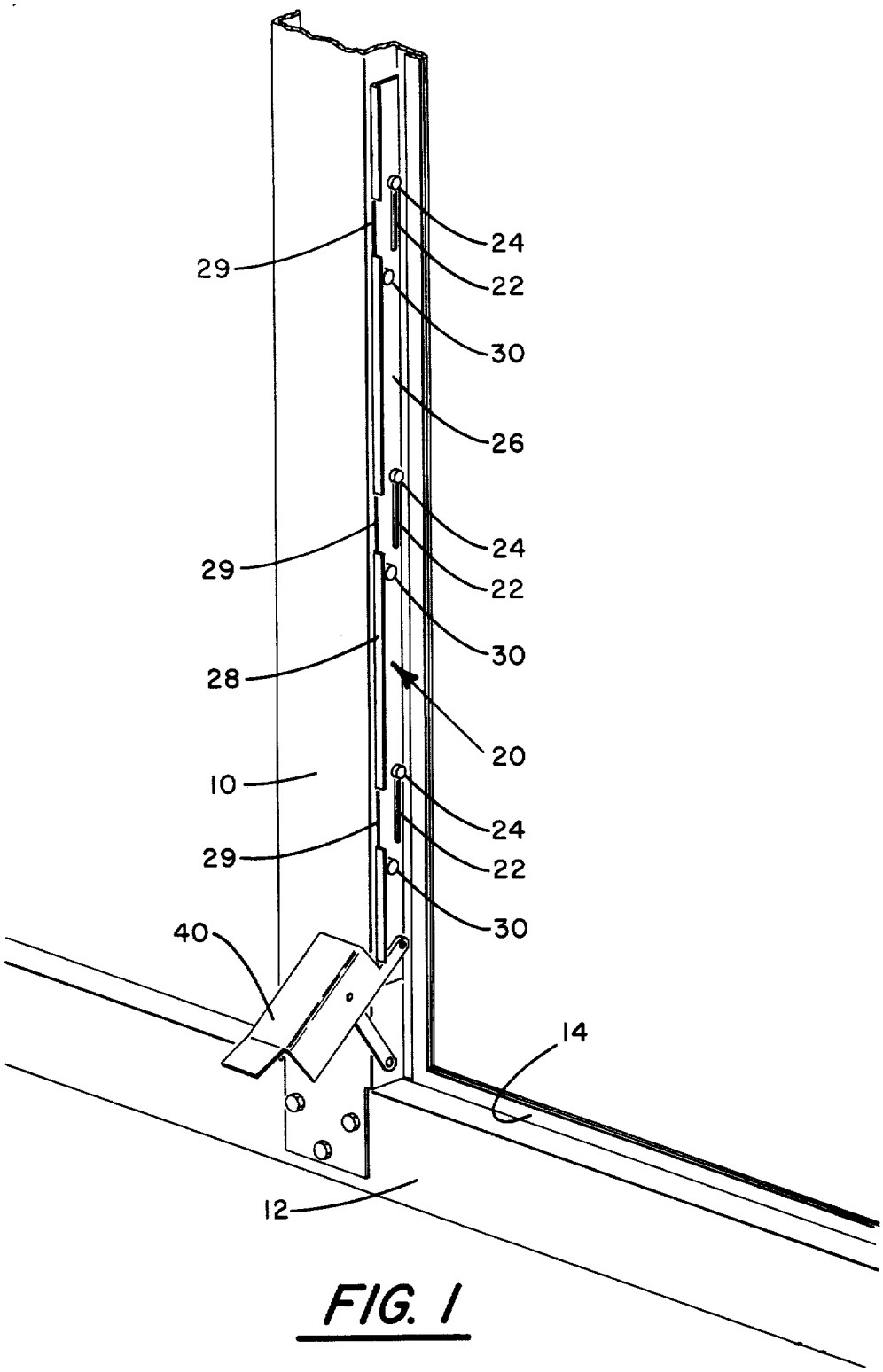
FIG. 1 is a perspective view of a door post and latch assembly.

Referring now to FIG. 1 there may be seen a perspective view of a door post having a latch assembly secured thereto. Post 10 is shown forming a vertical portion of the unit and is secured to frame 12. Lip 14 is shown extending upwardly from frame 12 defining a surface against which the door may abut. Latch assembly 20 is shown having a base plate 26 defining three elongated slots 22. Three fasteners 24 extend, one through each of the slots 22, to maintain the latch assembly affixed to the post in sliding engagement therewith. Fastener 24 may be two step bushings placed end to end and secured by a poppet extending through the center. Front edge 28 extends from the base plate 26 parallel to the front of post 10 towards the door opening. Front edge 28 additionally defines three edge openings 29 for allowing contact angles of the door to extend therethrough. Rollers 30 are shown mounted relative to the edge openings for engagement with the contact angles when the door is in the closed position. Latch handle 40 is shown pivotally mounted to both the base plate 26 and to door post 10 such that relative displacement of the latch handle effects upward and downward sliding motion of the entire latch assembly.

Figure 2:
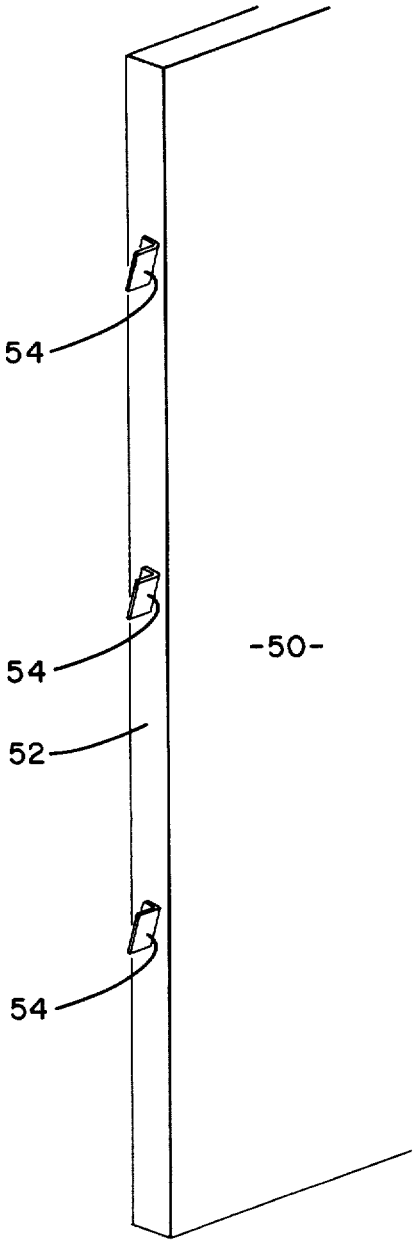
FIG. 2 is a perspective view of the end of the door opposite from the hinged end.

FIG. 2 is a perspective view of the end portion of door 50. Door 50 is designed to cover the opening to the right of the latch assembly as shown in FIG. 1. Connected to door end surface 52 which is a vertically extending surface generally parallel with base plate 26 when closed and generally tangent to an arch having the axis of rotation of the door as determined by the door hinge as its axis. Three contact angles 54 are shown mounted to the door end surface. The contact angles are shown inclined at an angle such that the bottom is located toward the interior of the unit and the top of the contact angle is angled outwardly toward the exterior of the unit.

Figure 3:
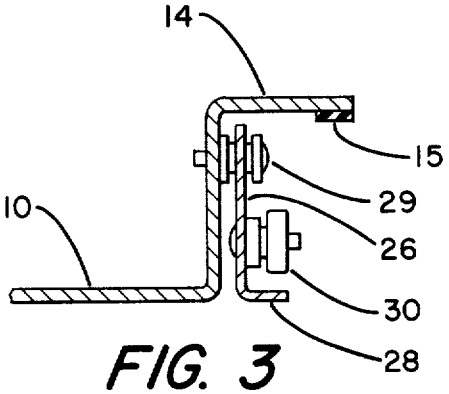
FIG. 3 is a sectional view of the door post and latch assembly of FIG. 1.

FIG. 3 is a sectional view of the latch assembly and door post showing door post 10 having lip 14 projecting therefrom. Seal 15 for engaging the door to form a water tight or air tight arrangement between the door and the post is additionally shown mounted thereon. Base plate 26 is shown secured to post 10 via fastener 24. Fastener 24 extends through slot 22 (not shown in FIG. 3) to secure the base plate in sliding arrangement to the door post. Rotatable contact means or roller 30 is shown mounted to base plate 26. Additionally, front edge 28 is shown extending from base plate 26 generally parallel to the front of post 10.

Figure 4:
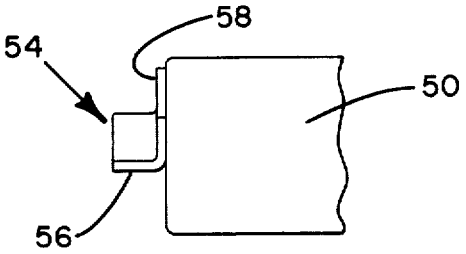
FIG. 4 is a top view of the end of the door in FIG. 2.

FIG. 4 is a top view of the end of door 50. Therein it can be seen that contact angles 54 are shown having contact face 56 mounted essentially out of sight in FIG. 4 and having a connection face 58 mounted parallel to the door end surface for securing the contact angle to the door.

Figure 5:
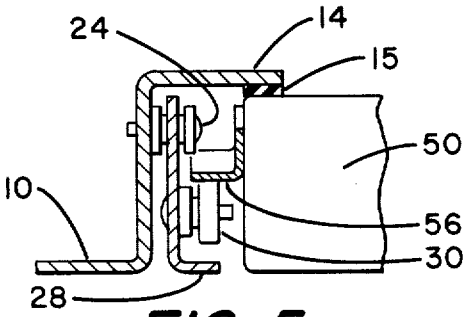
FIG. 5 is a sectional view of the door post, door latch assembly and contact angle showing the door secured in a closed position.

FIG. 5 is a combined view of FIGS. 3 and 4 showing the door secured in the latch assembly. In FIG. 5 it may be seen that roller 30 engages contact face 56 to hold the door 50 secured against seal 15. Fastener 24 cooperating with slot 22 secures the base plate such that it may not move inwardly and outwardly relative to post 10. Hence, when roller 30 is displaced upwardly by a sliding motion of the latch assembly, the roller engages the bottom portion of contact angle 54 first and then travels upwardly forcing the door inwardly. As the roller travels upwardly and since the contact angle is angled outwardly the door is therefore moved inwardly. In the closed position, as shown in FIG. 5, the contact angle is sufficiently engaged by roller 30 that the door compresses seal 15 to effect an appropriate seal between the door and the unit.

Figure 6:
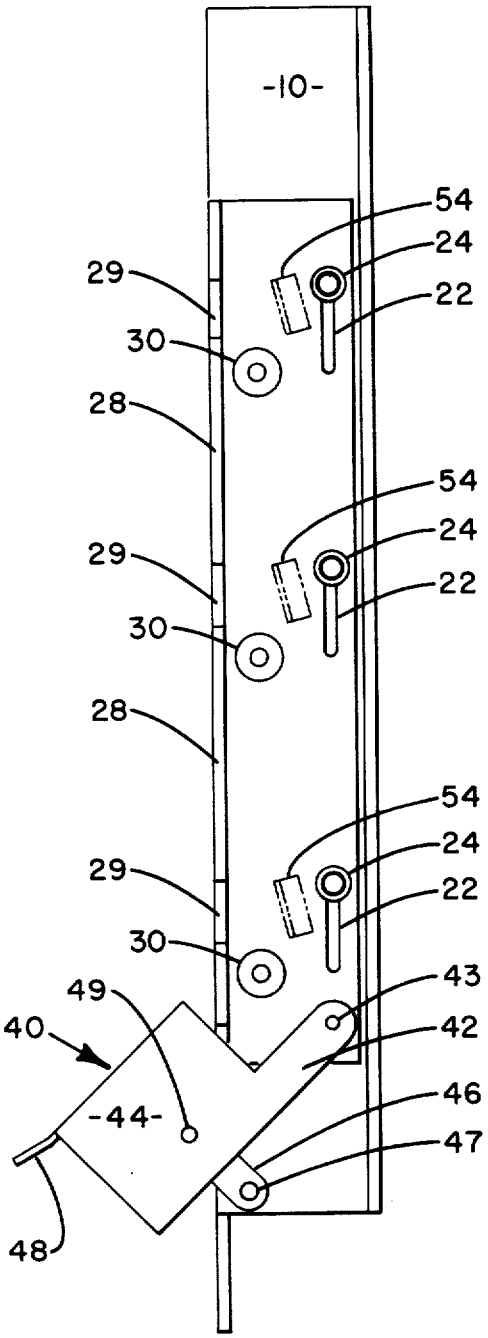
FIG. 6 is a side view of the latch assembly shown in the open position additionally showing the contact angles where they would be placed with the door in a closed position.

FIG. 6 shows a side view of the latch mechanism in the open position with the contact angles 54 drawn in to show their appropriate position. Latch assembly 20 including base plate 26 is shown mounted to post 10. The base plate defines slots 22 through which fasteners 24 extend for securing the latch assembly in sliding motion relative to the post. Since the slots 22 extend in one direction only, the latch assembly is allowed to slide only upwardly and downwardly as seen in FIG. 6. Additionally, contact rollers 30 are shown extending from base plate 26. Front edge 28 and front edge openings 29 may additionally be seen in FIG. 6. The contact angles 54 are shown spaced in position such that, with the latch assembly in the open position as shown, the contact angles may be rotated through the front edge openings 29 to the position as shown. Additionally, it may be seen in FIG. 6 that latch handle 40 includes a body portion 44, handle 48, pivot point 49, movable leg 46 secured by pivot point 47 to post 10 and a fixed leg 42 secured through fastening point 43 to latch assembly 20.

Figure 7:
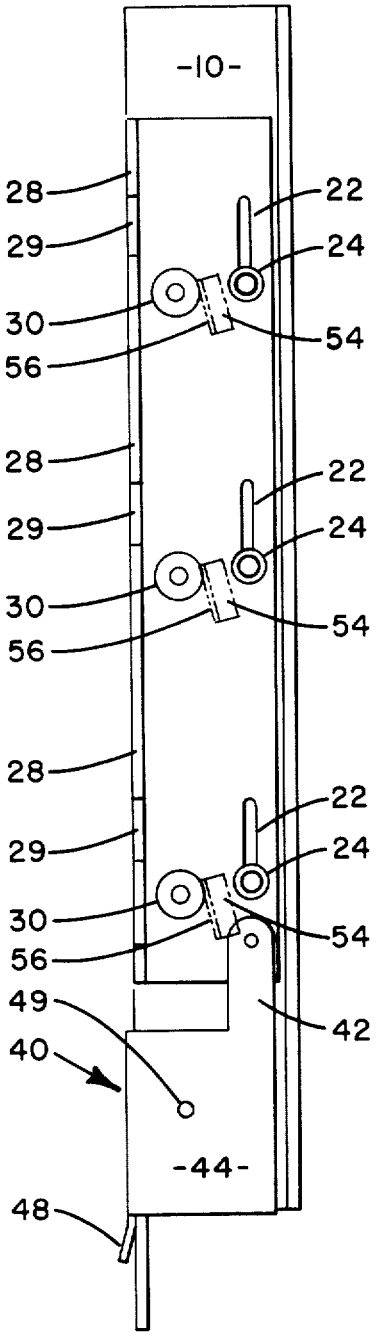
FIG. 7 is a side view similar to FIG. 6 with the latch assembly in the closed position securing the door in the closed position.
Figure 8:
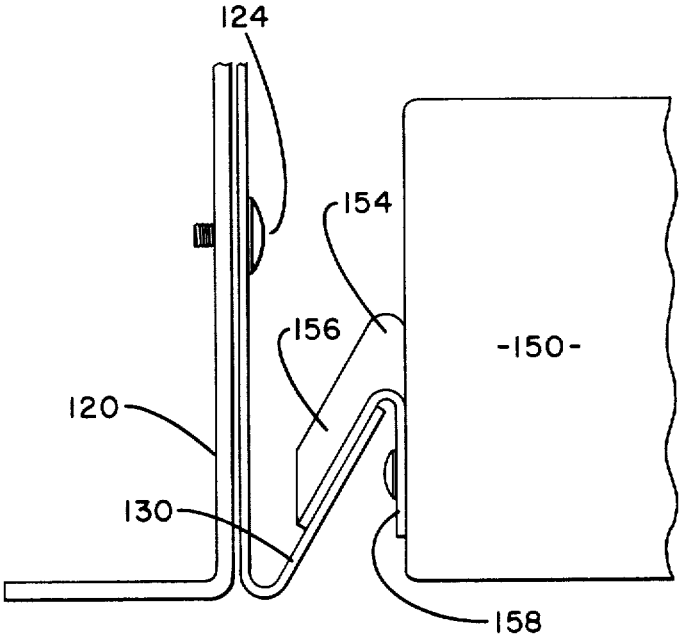
FIG. 8 PRIOR ART
FIG. 8 is a top view of a prior art door closure mechanism.

Referring now to FIG. 7, there may be seen the identical view as in FIG. 6 with the latch assembly in the closed position. In this position it may be seen that fasteners 24 are located at the opposite end of slots 22 and that contact rollers 30 engage contact faces 56 of the contact angles to secured the door. It may additionally be seen that front edge openings 29 are displaced upwardly that should rollers 30 fail, the door will be maintained from opening completely by the engagement of the contact angles with front edge 28. It may additionally be seen in FIG. 7 that the handle is in the closed position and does not project substantially outward from the unit.

The latch handle 40 acts in a similar manner to an overcenter spring. The latch handle includes two legs, one fixed and one movable, and a common pivot point. When moved to the open position as shown in FIG. 6, the latch handle acts to draw the latch assembly downwardly. When pushed inwardly at handle 48 to the closed position, as shown in FIG. 7, it may be seen that the latch assembly moves upwardly. In the closed position movable leg 46 is covered by body 44 and fixed leg 42, attached via fastening point 43 to the latch assembly, is displaced upwardly thereby displacing the entire assembly. The reverse motion occurs upon opening with handle 48 being displaced outwardly which acts to displace the fixed leg downwardly thereby moving the latch assembly downwardly.

As may be seen from the herein drawings, a latch assembly for engaging spaced projections extending from a door is disclosed. By engaging these spaced projections it is possible to secure the door at the top, bottom and center such that a relatively water tight seal arrangement is provided. Additionally, by utilizing roller bearings together with angled faces it is possible to provide a latch assembly which works freely and smoothly and which may be worked intermittently over a period of many years while remaining free and smooth. Additionally, by providing the combination of a roller and contact face arrangement there is sufficient tolerance built into the latching mechanism that minor displacements between the door post and the door will not effect the overall sealing arrangement.

The invention has been described herein with reference to a particular embodiment. It is to be understood that variations and modifications can be effected within the spirit and scope of the invention.

What is claimed is:

1. Apparatus for securing, to a frame member, the swinging end of a hinged door in a closed position, said door including an end surface extending the thickness of the door and being in a plane generally tangent to an arc having the door hinge as its center of rotation which comprises:

at least one contact projection mounted to and extending from the door end surface, said contact projection including a contact face projecting from the end surface of the door and angled from a line parallel to the axis of rotation of the hinge;

a latch assembly including a base plate mounted to and slidable relative to the frame member and a rotatable contact means mounted thereon capable of being arranged in registration with the contact projection for securing the door in the closed position, said base plate having a front edge extending towards the door, said front edge defining at least one opening through which said at least one contact projection may pass when the door is rotated about the hinge and said latch assembly is in an open position; and means for displacing the latch assembly between a closed position wherein the contact means is arranged in registration with the contact projection and an open position wherein the contact projection is not engaged by the contact means.

2. The apparatus as set forth in claim 1 wherein the base plate further defines as series of openings and further comprising a series of fasteners, mounted to the frame member, one each extending through the openings to provide a sliding connection between the fasteners and the openings such that the base plate may be slid between the open and closed positions.

3. The apparatus as set forth in claim 2 wherein the rotatable contact means extends from the base plate and is positioned to engage the contact projection extending from the door to hold the door in the closed position and is positioned not to engage the contact projections when in the open position.

4. The apparatus as set forth in claim 3 wherein there are three contact projections spaced on the door end surface and wherein the latch assembly includes three appropriately spaced contact means, one each for engaging the separate contact projections.

5. The apparatus as set forth in claim 1 wherein the means for displacing further comprises a lever pivotally connected to the base plate of the latch assembly and adapted to be connected to a portion of the frame member of a supporting structure defining an opening which the door covers, said lever acting to slide the plate upon relative rotation of the lever.

6. The apparatus as set forth in claim 1 wherein said at least one opening is positioned relative to the base plate such that when the latch assembly is in the closed position the contact projections of the door would engage the front edge preventing the door from opening should the rotatable contact means not engage the projection means.

7. Apparatus for securing a hinged rotating door in an air conditioning unit wherein the door defines a portion of an air flow passageway, said door extending to cover an opening into the unit which comprises:

at least one contact projection extending from an end surface of the door distance from the hinge, said contact projection being angled from a line parallel to the axis of rotation of the hinge;

a latch assembly including rotatable contact means for slidably engaging the contact projection extending from the door to secure the door in a closed position, said latch assembly including a base plate mounted in a sliding arrangement to a portion of the air conditioning unit adjacent the opening and the contact means mounted to and extending outwardly from the base plate, said base plate having a front edge extending toward the door whereby said front edge defines at least one opening through which said at least one contact projection may pass when said latch assembly is in an open position; and lever means pivotally attached to the base plate and to the air conditioning unit such that a displacement of the lever means results in a sliding displacement of the latch assembly.

8. The apparatus as set forth in claim 7 wherein the base plate defines slots extending in the directions that the latch assembly slides and further comprises fasteners projecting through the slots and being secured to the air conditioning unit to maintain the base plate in a sliding arrangement with the air conditioning unit.

9. The apparatus as set forth in claim 8 wherein the contact projections are inclined at an angle from the bottom toward the interior of the unit to the top toward the exterior of the unit and wherein upon the latch assembly being displaced to the closed position the rotatable contact means engage the bottom end of the contact projections first and then travel upwardly along the inclined projections forcing the door inwardly until the closed position is achieved.

10. The apparatus as set forth in claim 9 wherein multiple projections extend from the door and multiple contact means are mounted on the base plate, one to engage each contact projection.

* * * * *